US008888505B2

(12) United States Patent
Kobayashi et al.

(10) Patent No.: US 8,888,505 B2
(45) Date of Patent: Nov. 18, 2014

(54) BOARD-TO-BOARD CONNECTOR

(75) Inventors: Kotaro Kobayashi, Kanagawa (JP); Shozo Ichikawa, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 211 days.

(21) Appl. No.: 13/321,434

(22) PCT Filed: May 20, 2010

(86) PCT No.: PCT/US2010/035585
§ 371 (c)(1),
(2), (4) Date: Feb. 29, 2012

(87) PCT Pub. No.: WO2010/135540
PCT Pub. Date: Nov. 25, 2010

(65) Prior Publication Data

US 2012/0149217 A1 Jun. 14, 2012

(30) Foreign Application Priority Data

May 20, 2009 (JP) ..... 2009-122014

(51) Int. Cl.
*H01R 12/00* (2006.01)
*H01R 12/50* (2011.01)

(52) U.S. Cl.
CPC ..... *H01R 23/7073* (2013.01)
USPC ..... 439/74

(58) Field of Classification Search
USPC ..... 439/74, 65, 59, 631, 218
See application file for complete search history.

(56) References Cited

U.S. PATENT DOCUMENTS 5,472,354 A * 12/1995 Chen et al. ..... 439/357
5,549,479 A * 8/1996 Elco et al. ..... 439/67
5,626,482 A * 5/1997 Chan et al. ..... 439/74
5,685,726 A * 11/1997 Lwee et al. ..... 439/83
5,830,018 A * 11/1998 Simmel ..... 439/660

(Continued)

FOREIGN PATENT DOCUMENTS

JP 61-100761 1/1988
JP 1986-100761 1/1988

(Continued)

OTHER PUBLICATIONS

International Search Report for PCT/US2010/035585.

(Continued)

*Primary Examiner* — Amy Cohen Johnson
*Assistant Examiner* — Vladimir Imas
(74) *Attorney, Agent, or Firm* — Timothy M. Morella

(57) ABSTRACT

A board-to-board connector is disclosed. The connector comprises first and second connectors. The first connector has a first housing, a first terminal fitted therein, and is configured to be surface-mounted on a top surface of a first board. A fitting face thereof extends in a direction intersecting the top surface of the first board. The second connector has a second housing, a second terminal fitted therein and configured to make contact with the first terminal, and is configured to be surface-mounted on a top surface of a second board engaged with the first connector. A fitting face thereof extends in a direction intersecting the top surface of the second board. Either the first or second housing is provided with an insulating distance-procuring portion configured to protrude from a surface thereof and capable of procuring an insulating distance of the first or second terminal.

16 Claims, 12 Drawing Sheets

(56) References Cited

U.S. PATENT DOCUMENTS

| | | | | |
|---|---|---|---|---|
| 7,297,020 | B2 | 11/2007 | Takahira | |
| 7,458,863 | B2 | 12/2008 | Shimizu | |
| 7,462,036 | B2 * | 12/2008 | Shin et al. | 439/65 |
| 7,597,573 | B2 * | 10/2009 | Defibaugh et al. | 439/206 |
| 7,726,982 | B2 * | 6/2010 | Ngo | 439/79 |
| 7,959,445 | B1 * | 6/2011 | Daily et al. | 439/65 |
| 7,976,317 | B2 * | 7/2011 | Patel et al. | 439/79 |
| 8,388,355 | B2 * | 3/2013 | Shedletsky | 439/55 |
| 2008/0171451 | A1 * | 7/2008 | Shin et al. | 439/65 |
| 2009/0023322 | A1 | 1/2009 | Zeng | |

FOREIGN PATENT DOCUMENTS

| | | |
|---|---|---|
| JP | 1994-152340 | 1/1996 |
| JP | 1996-353511 | 6/1998 |
| JP | H08-353511 | 6/1998 |
| JP | 1999-048260 | 9/2000 |
| JP | 3571600 | 8/2001 |
| JP | 2002-208740 | 2/2004 |
| JP | H11-048260 | 9/2008 |
| WO | WO 2005/022699 A2 | 3/2005 |
| WO | WO 2010/045336 A1 | 4/2010 |

OTHER PUBLICATIONS

International Search Report for PCT/US2010/0035601, Jun. 30, 2010.

International Search Report for PCT/US2010/0035617, Sep. 9, 2010.

* cited by examiner

BOARD-TO-BOARD CONNECTOR

REFERENCE TO RELATED APPLICATIONS

The Present Disclosure claims priority to prior-filed Japanese Patent Application No. 2009-122014, entitled "Board-To-Board Connector," and filed 20 May 2009, the contents of which is fully incorporated in its entirety herein.

BACKGROUND OF THE PRESENT DISCLOSURE

The Present Disclosure relates to a board-to-board connector.

In order to electrically connect a pair of parallel circuit boards to each other, board-to-board connectors have traditionally been used, such as that disclosed in Japanese Utility Model Application No. 7-36375. Such a board-to-board connector connects a pair of circuit boards arranged in parallel to each other.

FIG. 12 illustrates another type of board-to-board connector. In FIG. 12, a male connector 801 is attached to a first circuit board 891, and a female connector 901 is attached to a second circuit board 991. The male connector 801 is provided with a male insulating housing 811 and a plurality of pin terminals 851 arranged in parallel to each other so as to pass through the male insulating housing 811. The distal ends of the pin terminals 851 are configured to protrude frontward from the distal end of the male insulating housing 811. The rear ends of the pin terminals 851 are configured to protrude rearward from the male insulating housing 811 and be bent downward to form male connection legs 852 which are configured to protrude downward. Each of the male connection legs 852 is inserted into each of a plurality of first through-holes 893 formed in the first circuit board 891 and is fixedly secured to be connected to a corresponding one of conductive traces of the first circuit board 891 by means of solders 892. In this way, the male connector 801 is mounted on the first circuit board 891.

The female connector 901 is provided with a female insulating housing 911 and a plurality of socket terminals 951 which is arranged in parallel to each other so as to be fitted in the female insulating housing 911. The rear ends of the socket terminals 951 are configured to protrude downward from the female insulating housing 911 to form female connection legs 952. Each of the female connection legs 952 is inserted into each of a plurality of second through-holes 993 formed in the second circuit board 991 and is fixedly secured to be connected to a corresponding one of conductive traces of the second circuit board 991 by means of solders 992. In this way, the female connector 901 is mounted on the second circuit board 991.

When the first circuit board 891 and the second circuit board 991 are connected together, the male connector 801 mounted on the first circuit board 891 is engaged by fitting with the female connector 901 mounted on the second circuit board 991. In this way, the respective pin terminals 851 are brought into contact with the corresponding socket terminals 951, and therefore, the first circuit board 891 is electrically connected to the second circuit board 991. Even when the male connector 801 and the female connector 901 are misaligned with each other, namely, displaced from each other, the displacement can be absorbed, so that the contact state between the pin terminals 851 and the corresponding socket terminals 951 and the engagement state between the male connector 801 and the female connector 901 can be maintained.

However, in the above-described board-to-board connector, the lower ends of the male connection legs 852 are configured to protrude from the rear surface of the first circuit board 891, and the lower ends of the female connection legs 952 are configured to protrude from the rear surface of the second circuit board 991. For this reason, a sufficient insulating distance might not be ensured between neighboring male connection legs 852 and neighboring female connection legs 952, respectively, and there might be a risk of short-circuit accidents.

Generally, in order to achieve electrical isolation without coating or covering neighboring conductive members with insulating materials, it is necessary to secure a sufficient insulating distance between the conductive members, namely, to secure a sufficiently long insulating distance. The insulating distance includes a clearance which is the shortest distance passing the space between two conductive members, and a creepage distance which is the shortest distance along the surface of the insulating materials between the two conductive members.

However, in the above-described conventional board-to-board connector, since nothing exists between the lower ends of neighboring male connection legs 852 protruding from the rear surface of the first circuit board 891 and between the lower ends of neighboring female connection legs 952 protruding from the rear surface of the second circuit board 991, the clearance and the creepage distance are short, and accordingly, there might be a risk of occurrence of short-circuit accidents.

When either one of the male or female connection legs 852, 952 are configured as terminals for connection to a power supply line, and both the first circuit board 891 and the second circuit board 991 are attached to a casing of an electronic apparatus, the insulating distance between the male connection legs 852 and the female connection legs 952 is short, and accordingly, there might be a risk of occurrence of short-circuit accidents.

In many cases, the casings of electronic apparatuses are generally formed of metals or composite materials of metals and resin and function as a ground line. In such cases, when a casing of an electronic apparatus exists at the rear side of the first circuit board 891 and the second circuit board 991, the insulating distance between the casing of the electronic apparatus and the lower ends of the male connection legs 852 protruding from the rear surface of the first circuit board 891 and the lower ends of the female connection legs 952 protruding from the rear surface of the second circuit board 991 becomes short, and accordingly, there might be a risk of occurrence of short-circuit accidents.

SUMMARY OF THE PRESENT DISCLOSURE

Therefore, it is an object of the Present Disclosure to solve the above-described problems encountered by the conventional board-to-board connector and to provide a board-to-board connector having a configuration such that a housing made of an insulating material is formed therein with an insulating distance-procuring portion for enabling to absorb any possible mutual displacement occurring between connectors. As a result, it is made possible to realize a small height and a miniaturization of a board-to-board connector while preventing occurrence of short-circuit accidents. Accordingly, the board-to-board connector has ability for enabling easy production thereof to have a simple structure with a small number of parts and at a low production cost.

Therefore, a board-to-board connector according to the Present Disclosure includes a first connector having a first housing made of an insulating material and a first terminal fitted in the first housing, the first connector being configured to be surface-mounted on a top surface of a first board and having a fitting face thereof extended in a direction to intersect the top surface of the first board; and a second connector having a second housing made of an insulating material and a second terminal fitted in the second housing and configured to make contact with the first terminal, the second connector being configured to be surface-mounted on a top surface of a second board to be engaged with the first connector and having a fitting face thereof extended in a direction to intersect the top surface of the second board, wherein: the first housing or the second housing is provided with an insulating distance-procuring portion which is configured to protrude outward from a surface thereof and be capable of procuring an insulating distance of the first terminal or the second terminal.

The board-to-board connector according to another embodiment of the Present Disclosure has a configuration such that the first housing is provided with a first bottom plate portion configured to oppose the top surface of the first board and is surface-mounted on an end of the first board, that the second housing is provided with a second bottom plate portion configured to oppose the top surface of the second board and is surface-mounted on an end of the second board, and that the insulating distance-procuring portion is a projecting plate portion which extends from a front end of the first bottom plate portion or the second bottom plate portion.

The board-to-board connector according to a further embodiment of the Present Disclosure has a configuration such that when the first connector and the second connector are engaged together, a portion of the first terminal or the second terminal is positioned right above a place between a front end of the first bottom plate portion and a front end of the second bottom plate portion, and the projecting plate portion covers an under part of a portion of the first terminal or the second terminal, which portion is positioned right above the portion disposed between the front end of the first bottom plate portion and the front end of the second bottom plate portion.

The board-to-board connector according to a still further embodiment of the Present Disclosure has a configuration such that the projecting plate portion includes a first projecting plate portion extending from the front end of the first bottom plate portion and a second projecting plate portion extending from the front end of the second bottom plate portion, and that the first projecting plate portion and the second projecting plate portion overlap with each other when the first connector and the second connector are engaged together.

The board-to-board connector according to a still further embodiment of the Present Disclosure has a configuration such that a conductive member is arranged on a rear surface of the first board or the second board.

The board-to-board connector according to a still further embodiment of the Present Disclosure has a configuration such that a plurality of the first terminals is provided, each of the first terminals being provided with a first surface connecting portion which is exposed from the surface of the first housing to be connected to the top surface of the first board, that a plurality of the second terminals is provided, each of the second terminals being provided with a second surface connecting portion which is exposed from the surface of the second housing to be connected to the top surface of the second board, and that the insulating distance-procuring portion includes a projecting wall portion which is arranged to project outward from the top surface of the first housing or the second housing between neighboring ones of the first surface connecting portions or those of the second surface connecting portions.

In accordance with the Present Disclosure, the board-to-board connector has a configuration in which the insulating distance-procuring portion is formed in the housing made of an insulating material. Owing to such a configuration, it is possible to absorb the possible mutual displacement that might occur between the connectors and to realize a small height and a miniaturization while preventing occurrence of short-circuit accidents. Accordingly, it is possible to provide a board-to-board connector which can be easily produced to have a simple structure with a small number of parts and at a low production cost.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 1A and 1B are perspective views of a first connector according to the Present Disclosure, in which FIG. 1A is a top front perspective view and FIG. 1B is a top rear perspective view, respectively;

FIGS. 2A and 2B are views illustrating the first connector mounted on a board, in which FIG. 2A is a top plan view and FIG. 2B is a side view, respectively;

FIGS. 5A and 5B are perspective views of a second connector, in which FIG. 5A is a top front perspective view and FIG. 5B is a top rear perspective view, respectively;

FIGS. 6A and 6B are views illustrating the second connector mounted on a board, in which FIG. 6A is a top plan view and FIG. 6B is a side view, respectively;

FIGS. 9A and 9B are perspective views of the first and second connectors in their tightly engaged state, in which FIG. 9A is a top rear perspective view of the second connector and FIG. 9B is a top rear perspective view of the first connector, respectively;

DESCRIPTION OF THE PREFERRED EMBODIMENTS

Figure 1A:
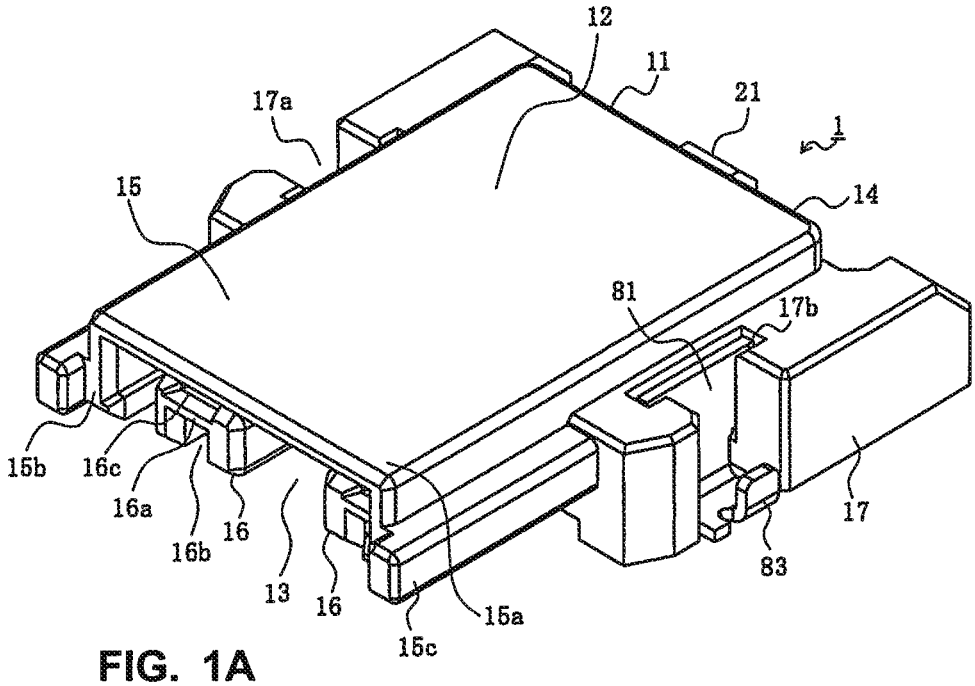

While the Present Disclosure may be susceptible to embodiment in different forms, there is shown in the Figures, and will be described herein in detail, with the understanding that the disclosure is to be considered an exemplification of the principles of the Present Disclosure, and is not intended to limit the Present Disclosure to that as illustrated.

In the Present Disclosure, directional representations—i.e., up, down, left, right, front, rear and the like, used for explaining the structure and movement of the various elements of the Present Disclosure, are relative. These representations are appropriate when the elements are in the position shown in the Figures. If the description of the position of the elements changes, however, it is assumed that these representations are to be changed accordingly.

In the drawing figures, a first connector as a male board connector which is one of a pair of connectors constituting a board-to-board connector, generally designated by reference numeral 1, is a surface-mounted connector, which is mounted on a top surface of a first board 91 as a board. The first connector 1 is engaged, by fitting, with a later-described second connector 101 as a female board connector which is the other one of the pair of connectors constituting the board-to-board connector. The second connector 101 is a surface-mounted connector which is mounted on a surface of a second board 191 as a board.

The board-to-board connector includes the first connector 1 and the second connector 101, and is configured to electrically connect the first board 91 and the second board 191 to each other. Although the first connector 1 and the second connector 101 will be described as connectors for connecting power supply lines of the first board 91 and the second board 191, the first connector 1 and the second connector 101 may be used as connectors for connecting signal lines.

Moreover, the first board 91 and the second board 191 are printed circuit boards used for an electronic device or apparatus for example, and may be silicon boards or silicon carbide boards having an electronic device or apparatus arranged directly thereon or may be any type of boards. Furthermore, examples of the electronic device or apparatus include a personal computer, a cellular phone, a digital TV, a car navigation device, and a games machine and the like; however, the type of devices and apparatuses is not intended to be particularly limited.

The first connector 1 includes a first housing 11 as a male board housing which overall has a generally flat rectangular parallelepiped shape and is integrally made of an insulating material such as synthetic resin, first terminals 51 as male board terminals which are made from metal and fitted in the first housing 11, and first auxiliary metallic brackets 81 as male board housing-attachment auxiliary metallic brackets which are made from metal and attached to the first housing 11. In the example illustrated in the drawing figures, although the number of first terminals 51 is two assuming that the power supply lines include one positive line and one negative line, the number of first terminals 51 may be arbitrarily changed to comply with the number of power supply lines.

As illustrated in the drawing figures, the first housing 11 is provided with a first top plate portion 12 as a top plate portion having a generally rectangular flat-plate shape, a first bottom plate portion 18 as a bottom plate portion which has a flat plate shape opposing the top surface of the first board 91 and extends in parallel to the first top plate portion 12, a first body portion 14 as a body portion which has top and bottom surfaces thereof being defined by the first top plate portion 12 and the first bottom plate portion 18 and holds therein the first terminals 51, and a pair of first side wall portions 17, as side wall portions, which is formed so as to extend along edges on both left and right sides of the first body portion 14 and upstand from the first top plate portion 12 and the first bottom plate portion 18. Furthermore, a first fitting face 11*a* as a fitting face is configured to be extended in a direction intersecting (preferably, in a direction substantially perpendicular to) the top surface of the first board 91.

The first body portion 14 has formed therein, on a rear end face thereof (the left end face in FIGS. 2 and 3), first terminal accommodation-concave portions 14*b* which are configured to extend in the distal end direction (the rightward direction in FIGS. 2 and 3) from the rear end face and accommodate therein the first terminals 51 and first terminal holding grooves 14*a* which are arranged on the upper ends of the first terminal accommodation-concave portions 14*b* so as to hold therein the first terminals 51. In the example illustrated in the drawing figures, although the numbers of first terminal holding grooves 14*a* and those of first terminal accommodation-concave portions 14*b* are two, respectively, the respective numbers of first terminal holding grooves 14*a* and first terminal accommodation-concave portions 14*b* may be arbitrarily changed to comply with the number of first terminals 51.

Each of the first side wall portions 17 has formed therein a concave portion 17*a* and a bracket holding groove 17*b* so that both end portions of each of the first auxiliary metallic brackets 81 are accommodated and held in the bracket holding groove 17*b*. Moreover, first connecting portions 83 as connecting portions, which are formed on the lower ends of the first auxiliary metallic brackets 81, are fixedly secured, by soldering or the like, to first connector fixing portions 94 such as solder pads which are formed on the top surface of the first board 91. In this way, the first connector 1 can be firmly secured to the first board 91. As illustrated in FIGS. 1 and 2, it is preferable that the first auxiliary metallic brackets 81 and the first connecting portions 83 do not protrude rightward or leftward from the side faces of the first side wall portions 17.

A first engagement portion as an engagement portion, designated by reference numeral 15 is configured to extend in the distal end direction from the first body portion 14 so as to be engaged with the second connector 101. The first engagement portion 15 is provided with a first engagement top plate portion 15*a* which is formed to be even with the first top plate portion 12, a pair of first engagement side wall portions 15*b* which extends along the edges of the left and right sides of the first engagement top plate portion 15*a* while vertically extending downward (in a direction toward the first board 91) from the first engagement top plate portion 15*a*, and first convex engagement portions 15*c* which have a rod-like shape with a rectangular cross section and are configured to extend along the lower ends of the first engagement side wall portions 15*b*, bulge outward from the left and right end faces of the first engagement side wall portions 15*b*, and slightly protrude in the distal end direction from the front ends of the first engagement side wall portions 15*b*. In other words, the first engagement top plate portion 15*a* can be referred to as a portion of the first top plate portion 12.

A first concave engagement portion designated by reference numeral 13 is configured to be engaged with the second connector 101 and has three sides thereof being defined by the first engagement top plate portion 15*a* and the first engagement side wall portions 15*b*. In the first concave engagement portion 13, first terminal restricting portions 16 as terminal restricting members are arranged so as to extend in the distal end direction from the first body portion 14. The first terminal restricting portions 16 are generally rod-like members having a base end thereof being connected to the first body portion 14 and a distal end thereof being configured as a free end. In the example illustrated in the drawing figures, although the number of first terminal restricting portions 16 is two, the number of first terminal restricting portions 16 may be arbitrarily changed to comply with the number of first terminals 51.

The distal end portion of each of the first terminal restricting portions 16 has a generally H-shape and includes a beam portion 16*a* which extends in a lateral direction, a lower groove portion 16*b* which has a rectangular cross section with an opened lower surface and is formed on the lower surface side of the beam portion 16*a*, and an upper groove portion 16*c* which has a rectangular cross section with an opened upper surface and is formed on the upper surface side of the beam portion 16*a*. The beam portions 16*a* are connected to tongue-shaped portions 16*d* which extend toward the base ends of the first terminal restricting portions 16.

Figure 4:
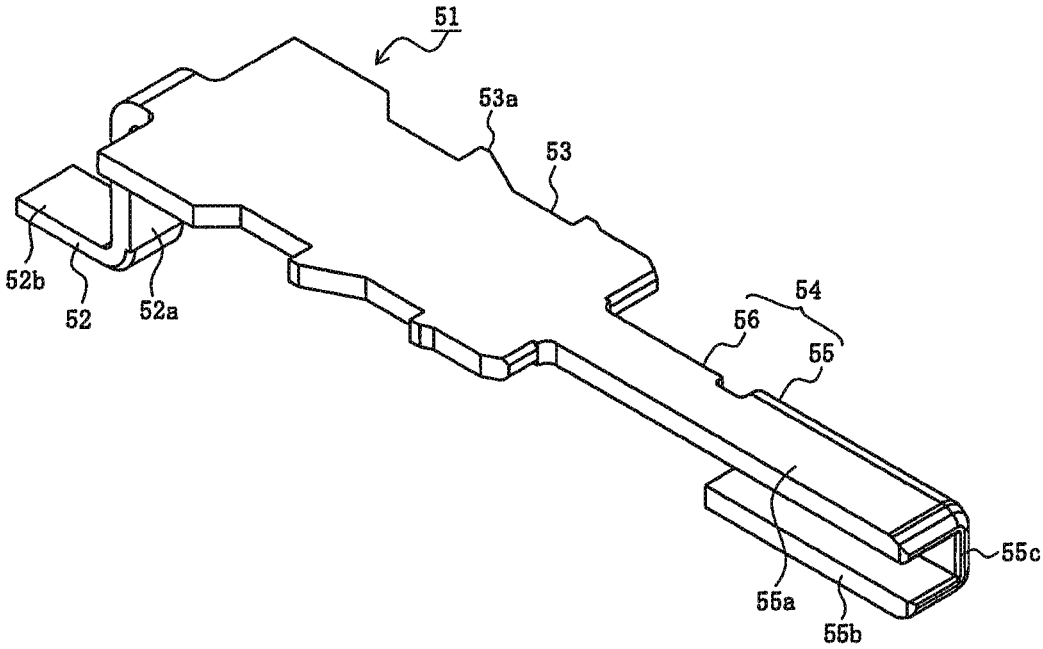
FIG. 4 is a perspective view of the first terminal according to the Present Disclosure.

The first terminals 51 are integrally formed, respectively, by applying processing, e.g., bending or punching, to a metal plate. As illustrated in FIG. 4, each of the first terminals 51 is provided with a first fixing portion 53 as a body portion, a first tail portion 52 as a first surface connecting portion which is connected to the rear end of the first fixing portion 53, and a first contacting arm portion 54 which is connected to the front end of the first fixing portion 53. The first fixing portion 53 is held in a state of being press-fitted into the first terminal holding groove 14*a* of the first body portion 14, and is provided with first locking projections 53*a* which project outward from the lateral sides thereof, the first locking projections 53*a* being squeezed into the wall surfaces of the first terminal holding groove 14*a*, thereby realizing a firm holding state.

The first tail portion 52 has a generally crank-like lateral shape. The first tail portion 52 is provided with a vertical leg portion 52*a* which extends in the vertical direction and has an upper end thereof bent at about right angles to be connected to the rear end of the first fixing portion 53 and a connecting plate portion 52*b* which is bent at about right angles to be connected to the lower end of the vertical leg portion 52*a*. The connecting plate portion 52*b* is electrically connected and secured, by soldering or the like, to a first connector electrode portion 93, such as a conductive pad, formed on the top surface of the first board 91. Hence, the first terminals 51 are connected to non-illustrated conductive traces for power supply of the first board 91, formed to be connected to the first connector electrode portions 93. Although the first tail portion 52 is exposed rearward (in the leftward direction in FIGS. 2 and 3) from the rear surface of the first body portion 14, it is preferable that the first tail portion 52 does not protrude rearward beyond the rear end of each of the first side wall portions 17 and does not protrude upward from the upper end of each of the first side wall portions 17.

The first contacting arm portion 54 is provided with a first contacting distal end portion 55 and a first flexible portion 56. The first contacting distal end portion 55 is a portion which comes into contact with either one of later-described second terminals 151 of the second connector 101. The first contacting distal end portion 55 is a channel-shaped portion having a substantially square cross-section opened at one side and extending in the distal end direction from the distal end of the first flexible portion 56. The first contacting distal end portion 55 includes a top plate portion 55*a* connected to the distal end of the first flexible portion 56, a bottom plate portion 55*b* extending in parallel to the top plate portion 55*a*, and a side plate portion 55*c* which connects either of the left and right lateral edges of the top plate portion 55*a* and the bottom plate portion 55*b* and extends in the same direction as the extending direction of the top plate portion 55*a* and the bottom plate portion 55*b*.

The first flexible portion 56 is an elongated plate-like member that is narrower than the width of the first fixing portion 53 and has a base end thereof being connected to the distal end of the first fixing portion 53 while having a distal end thereof being connected to the base end of the first contacting distal end portion 55. Since the first flexible portion 56 has a small secondary section modulus in the vertical direction as is obvious from its shape, the first flexible portion 56 has a low rigidity in the vertical direction and functions as a flat spring of which the distal end is elastically displaced in the vertical direction. Therefore, the first contacting distal end portion 55 connected to the distal end of the first flexible portion 56 is able to elastically deform in the vertical direction to the first fixing portion 53. Moreover, since the first contacting distal end portion 55 per se has a channel shape having a cross-section in the form of substantially squared U-shape, the first contacting distal end portion 55 has a larger secondary section modulus than the first flexible portion 56 in the vertical direction and has a high rigidity in the vertical direction and therefore will not function as a flat spring. Furthermore, since the first fixing portion 53 has a larger width than the first flexible portion 56 and has left and right sides thereof being held by the first terminal holding groove 14*a*, the first fixing portion 53 has a high rigidity in the vertical direction and therefore will not function as a flat spring.

Figure 3:
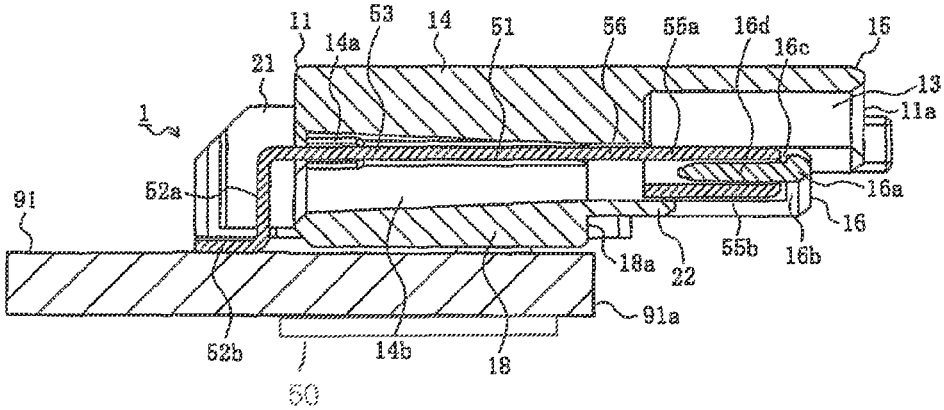
FIG. 3 is a side sectional view of the first connector mounted on the board, taken along the arrows A-A in FIG. 2A.

As illustrated in FIG. 3, when the first terminals 51 are fitted into the first housing 11, the tongue-shaped portions 16*d* of the first terminal restricting portions 16 are inserted from the side of the distal ends of the first contacting distal end portions 55 into portions disposed between the top plate portions 55*a* and the bottom plate portions 55*b* of the first contacting distal end portions 55. Here, the vertical dimension, namely the thickness of the tongue-shaped portion 16*d* is designed to be smaller than the vertical dimension, namely the vertical spacing between the lower surface of the top plate portion 55*a* and the upper surface of the bottom plate portion 55*b*. Therefore, the first contacting distal end portions 55 are able to be vertically and elastically displaced in the state where the first terminals 51 are fitted into the first housing 11. However, when the lower surface of the top plate portion 55*a* comes into abutting contact with the upper surface of the tongue-shaped portion 16*d*, the first contacting distal end portion 55 is unable to be displaced further downward. Similarly, when the upper surface of the bottom plate portion 55*b* comes into abutting contact with the lower surface of the tongue-shaped portion 16*d*, the first contacting distal end portion 55 is unable to be displaced further upward. In other words, the amount of vertical displacement of the first contacting distal end portion 55 is regulated to a predetermined amount by the first terminal restricting portion 16. Moreover, by adjusting the thickness dimension or the vertical position of the tongue-shaped portion 16*d*, it is possible to control the amount of vertical displacement of the first contacting distal end portion 55.

The first housing 11 has formed therein a rearwardly projecting wall portion 21 functioning as an insulating distance-procuring portion which is a projecting wall portion configured to rearwardly project from the rear surface of the first body portion 14. The rearwardly projecting wall portion 21 is formed to be positioned between two of the first terminals 51 which are exposed rearward from the rear surface of the first body portion 14. Therefore, it is possible to procure a sufficient insulating distance, namely to procure a sufficiently long insulating distance at least between portions (including a portion of the rear end of the first fixing portion 53 and the first tail portion 52) of two neighboring ones of the first terminals 51 exposed from the rear surface of the first body portion 14. Here, it is preferable that the rearwardly projecting wall portion 21 is at least formed so as to protrude further rearward and upward from the vertical leg portion 52*a* of the first tail portion 52.

Figure 1B:
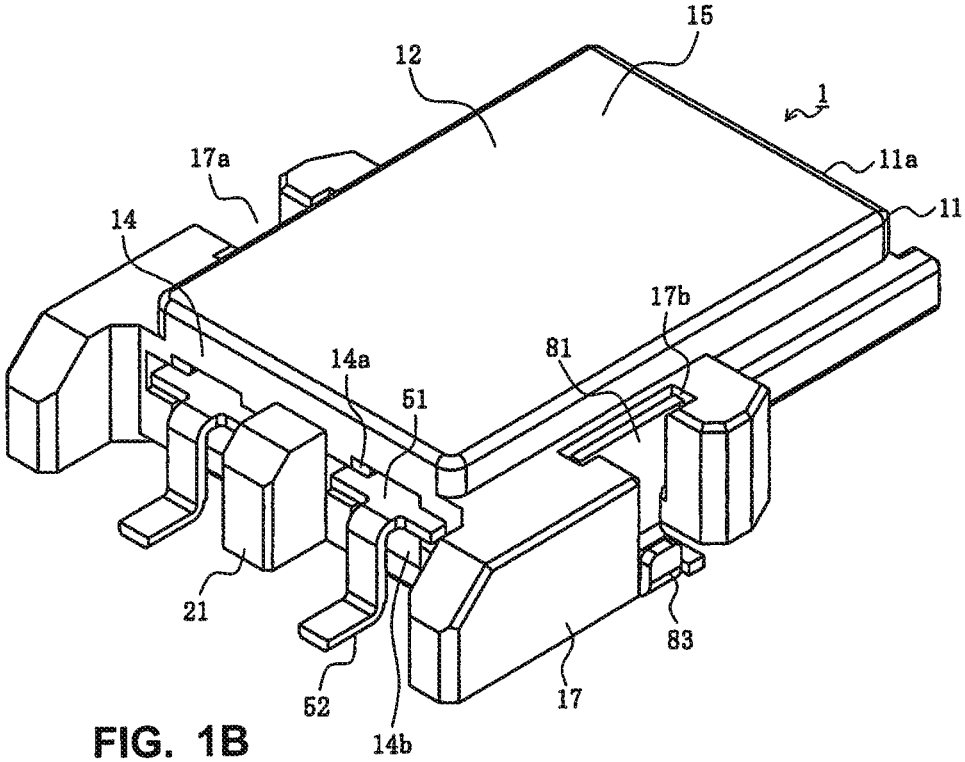
Figure 2A:
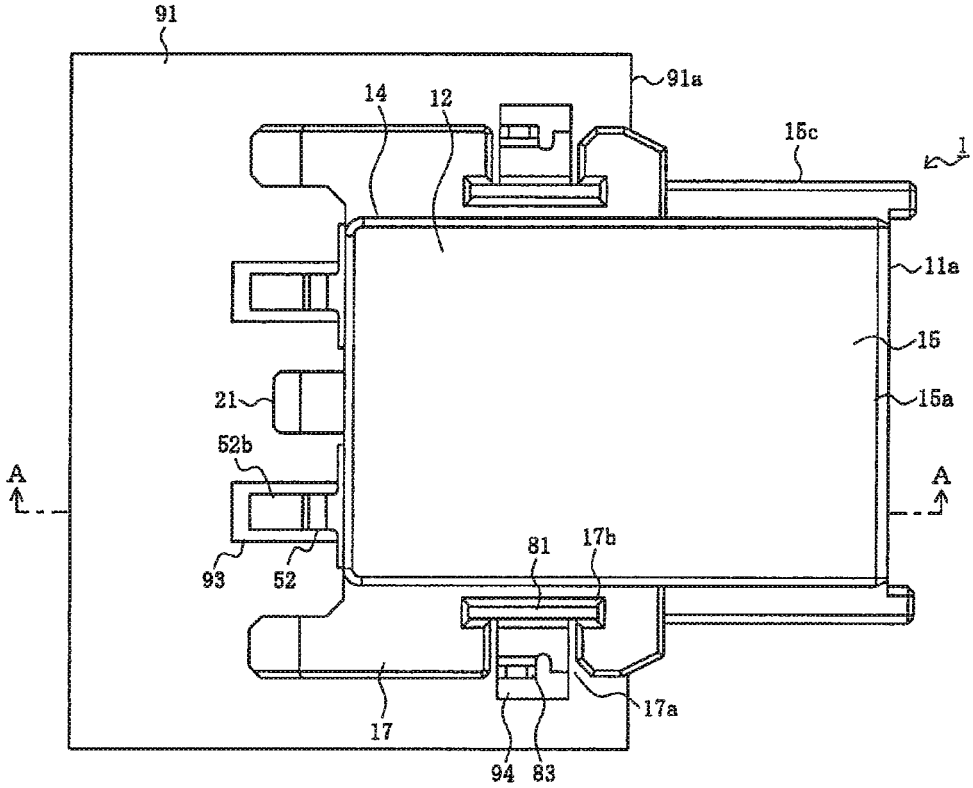
Figure 2B:
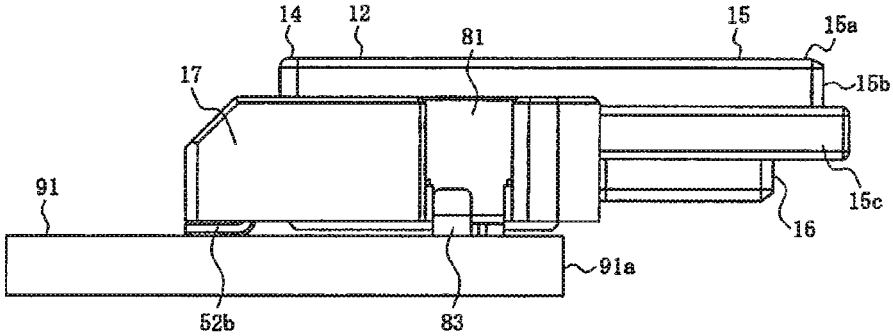

If a state is assumed where the rearwardly projecting wall portion 21 is omitted from FIGS. 1B and 2A, it can be easily understood that owing to the presence of the rearwardly projecting wall portion 21, both the clearance and the creepage distance between the left and right two first tail portions 52 are increased. Owing to such a configuration, short-circuit accidents will not occur between two of the first terminals 51 even when the potential applied between the two of the first terminals 51 is increased. Moreover, the first terminals 51 are so-called surface-mounted terminals, and moreover, as described above, the connecting plate portions 52*b* of the first tail portions 52 are electrically connected, by soldering or the like, to the first connector electrode portions 93 formed on the top surface of the first board 91, and none of the portions of the first tail portions 52 are exposed to the rear side of the first board 91. Therefore, owing to the rearwardly projecting wall portion 21 disposed closer to the top surface of the first board 91, it is possible to procure the insulating distance between the left and right two first tail portions 52.

The first connector 1 is mounted on the end of the first board 91 as illustrated in FIGS. 2 and 3 because it is designed to be engaged, by fitting, with the second connector 101 mounted on the end of the second board 191. Although only portions disposed in the vicinity of the end of the first board 91 are illustrated in FIGS. 2 and 3 for convenience's sake, actually, the first board 91 is in rectangular shape, for example, and is larger than the illustration, and the first connector 1 is mounted on one end of its both longitudinal ends. Specifically, as illustrated in FIG. 3, the first connector 1 is mounted at such a position that the first fitting face 11*a* protrudes outward from an end face 91*a* of the first board 91 and that a front end face 18*a* of the first bottom plate portion 18 of the first housing 11 becomes substantially even with the end face 91*a* which is one of both longitudinal ends of the first board 91. It should be noted that the front end face 18*a* of the first bottom plate portion 18 is not necessary perfectly even with the end face 91*a* of the first board 91; however, it is preferable that the distance between the front end face 18*a* of the first bottom plate portion 18 and the end face 91*a* of the first board 91 is short, as illustrated in FIG. 3.

The front end face 18*a* of the first bottom plate portion 18 is provided with a first projecting plate portion 22 which is connected thereto as a projecting plate portion which is formed to extend frontward. The first projecting plate portion 22 is formed to extend in the distal end direction from the upper end of the front end face 18*a* so as to cover an under part of substantially the entire of the first flexible portion 56 of the first terminal 51 fitted into the first housing 11 and included in a region located at a front side more than the front end face 18*a*, while also covering an under part of a portion of the first contacting distal end portion 55 located adjacent to the rear end of said end portion 55. The front end of the first projecting plate portion 22 is connected to the base end of the first terminal restricting portion 16.

When a conductive member 50 such as a conductive casing, a conductive plate for electromagnetic shielding, a metal plate for fixation, radiation, or reinforcement, another printed circuit board, another wiring component, or a fixing bracket is arranged on the rear side of the first board 91, the first projecting plate portion 22 functions as an insulating distance-procuring portion. Since the conductive member 50 functions as a ground at zero electric potential, a potential difference may appear between the first terminal 51 and the conductive member 50. If the first projecting plate portion 22 is omitted, the insulating distance between a portion of the conductive member 50 arranged on the rear side of the first board 91 and located closer to the front side than the end face 91*a* and the first flexible portion 56 and the first contacting distal end portion 55 will be shortened. However, since the first projecting plate portion 22 covers the under part of substantially the entire portions of the first flexible portion 56 and the portion thereof located closer to the rear end of the first contacting distal end portion 55, both the spatial distance and the creepage distance between the conductive member 50 and the first flexible portion 56 and the first contacting distal end portion 55 can be sufficiently lengthened and thus, a sufficient insulating distance can be procured. Although the first projecting plate portion 22 does not appear at an under part of the most portion of the first contacting distal end portions 55 which is located close to the distal end of the same end portion 55, when the first connector 1 and the second connector 101 are engaged together by fitting, the most part in the vicinity of the distal end of the first contacting distal end portion 55 are inserted in a later-described second housing 111 of the second connector 101. Therefore, it is possible to procure a sufficient insulating distance between the conductive member 50 and the first terminal 51 even when the first contacting distal end portion 55 does not appear.

The second connector 101 includes a second housing 111 as a female board housing which has a generally rectangular overall shape and is integrally formed of an insulating material such as synthetic resin, second terminals 151 as female board terminals which are made of metallic material and fitted in the second housing 111, and second auxiliary metallic brackets 181 as female board housing-attachment auxiliary metallic brackets which are made of metallic material and attached to the second housing 111. In the example illustrated in the drawing figures, although similar to the first terminals 51, the number of second terminals 151 is two assuming that the power supply lines includes one positive line and one negative line, the number of second terminals 151 may be arbitrarily changed to comply with the number of power supply lines.

As illustrated in the drawing figures, the second housing 111 is provided with a second bottom plate portion 118 as a bottom plate portion which has a generally rectangular flat-plate shape opposing the top surface of the second board 191, a second body portion 114 as a body portion which is formed so as to extend along an edge on the rear side (the left end in FIGS. 6 and 7) of the second bottom plate portion 118 and upstand from the second bottom plate portion 118, thereby holding therein the second terminals 151, and a pair of second side wall portions 117, as side wall portions, which is formed so as to extend along edges on both left and right sides of the second bottom plate portion 118 and upstand from the second bottom plate portion 118. Moreover, a second fitting face 111*a* as a fitting face is configured to extend in a direction intersecting (preferably, in a direction substantially perpendicular to) the top surface of the second board 191. The rear ends of the second side wall portions 117 are connected to both left and right ends of the second body portion 114, the upper surface portions of the second side wall portions 117 and the upper surface portion of the second body portion 114 are formed to be continuous and even with each other, thus constituting a second top plate portion 112 having a substantially squared U-shape. Moreover, a central concave portion designated by reference numeral 113 has a lower portion thereof being defined by the second bottom plate portion 118 and three sides thereof being defined by the second side wall portions 117 and the second body portion 114.

The second body portion 114 has formed therein, on a rear end face thereof, second terminal accommodation-concave portions 114*a* which are configured to extend in the distal end direction (the rightward direction in FIGS. 6 and 7) from the rear end face and accommodate therein the second terminals 151 and second terminal holding portions 114*b* which are arranged at positions of the second terminal accommodation-concave portions 114*a* located between the second bottom plate portion 118 and the second top plate portion 112 so as to hold therein the second terminals 151. In the example illustrated in the drawing figures, although the number of second terminal accommodation-concave portions 114*a* is two, respectively, the number of second terminal accommodation-concave portions 114*a* may be arbitrarily changed to comply with the number of second terminals 151.

Figure 5A:
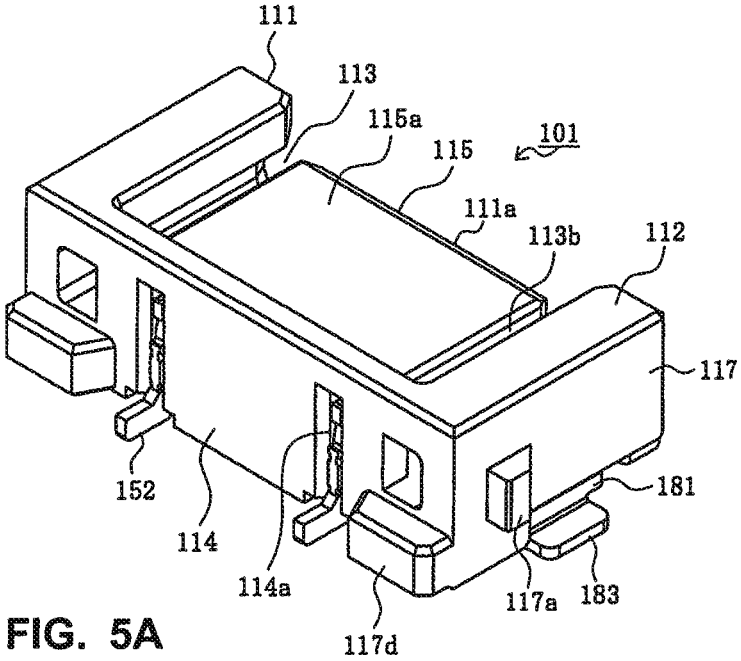
Figure 5B:
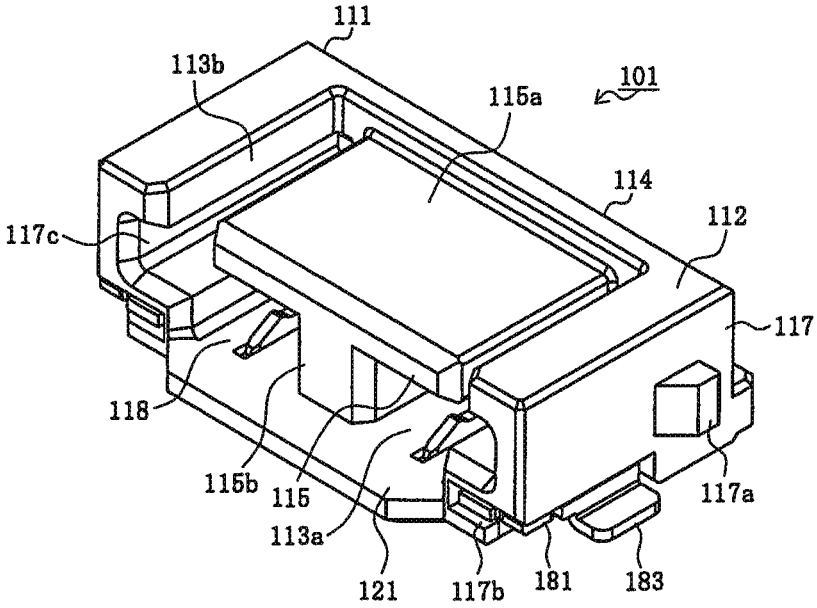
Figure 6A:
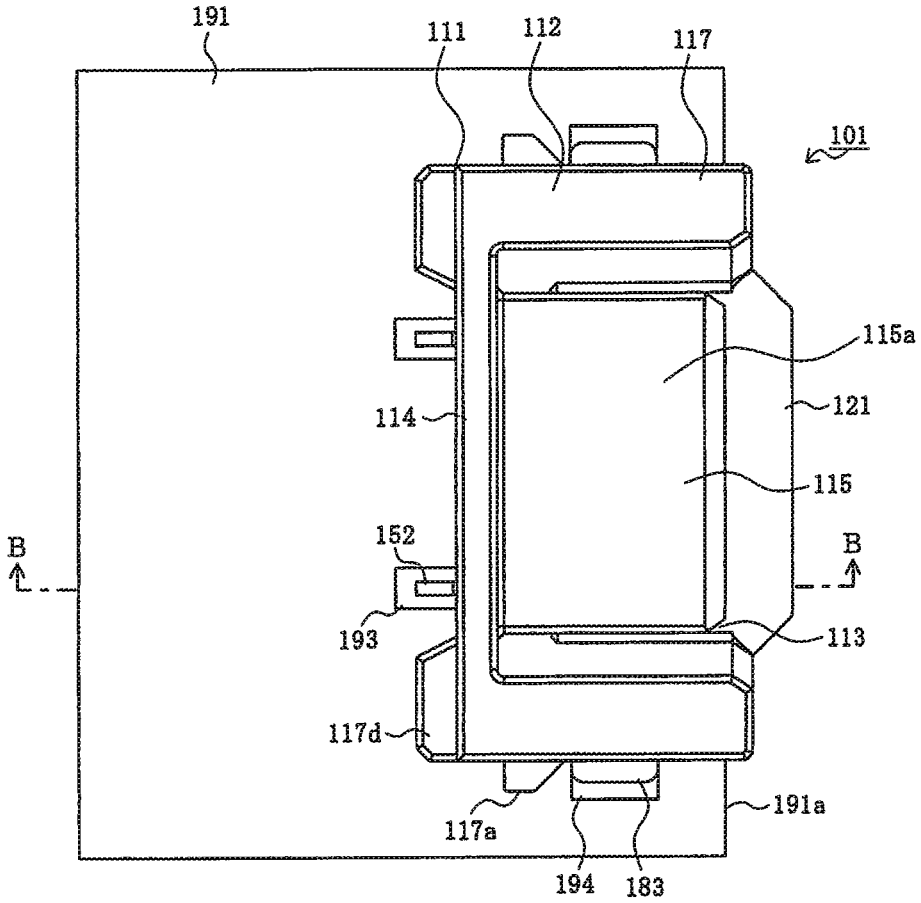
Figure 6B:
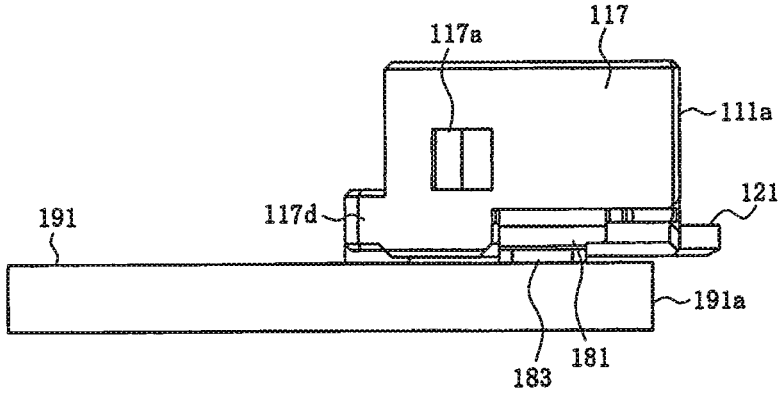

Each of the second side wall portions 117 has formed therein laterally convex portions 117*a* which are formed on side faces thereof so as to protrude laterally. Moreover, each of the second side wall portions 117 has formed therein rearwardly convex portions 117*d* which are formed on a rear face thereof so as to protrude rearward. Furthermore, each of the second side wall portions 117 has formed therein bracket holding grooves 117*b* which are formed in the vicinity of the lower end thereof so as to extend in the front-to-rear direction so that the second auxiliary metallic brackets 181 are accommodated in the bracket holding grooves 117*b*. In addition, second connecting portions 183 as connecting portions, which are formed so as to laterally protrude from the lateral ends of the second auxiliary metallic brackets 181, are fixedly secured, by soldering or the like, to second connector fixing portions 194 such as solder pads which are formed on the top surface of the second board 191. In this way, the second connector 101 can be firmly secured to the second board 191. As illustrated in FIGS. 5 and 6, it is preferable that the second auxiliary metallic brackets 181 and the second connecting portions 183 do not protrude rightward or leftward from the laterally convex portions 117*a* of the second side wall portions 117.

A second engagement portion as an engagement portion, designated by reference numeral 115 is arranged within the central concave portion 113 so as to be engaged with the first connector 1. The second engagement portion 115 is provided with a second engagement top plate portion 115*a* which is formed to be in parallel to the second top plate portion 112, and a second engagement support wall portion 115*b* which extends in the front-to-rear direction and supports the second engagement top plate portions 115*a*. The second engagement support wall portion 115*b* is formed so as to upstand from the second bottom plate portion 118 at the central portion in the width direction of the second bottom plate portion 118 and has its upper end to which the second engagement top plate portion 115*a* is connected.

The second engagement top plate portion 115*a* is arranged at a lower position than the second top plate portion 112 which surrounds the three sides thereof. When the first connector 1 and the second connector 101 are engaged together by fitting, the first engagement top plate portion 15*a* of the first engagement portion 15 is positioned so as to overlap the upper surface of the second engagement top plate portion 115*a* so that the upper surface of the first engagement top plate portion 15*a* becomes substantially even with the upper surface of the second top plate portion 112. The upper surface of the second engagement top plate portion 115*a* is smooth and flat and may function as a suctioned surface which is absorbed and sucked by a suction tool arranged at the distal end of a tool such as a robot hand, during assembling steps for mounting the second connector 101 on the top surface of the second board 191. The absorption and suction by the suction tool is generally impossible when an uneven structure such as a scratch exists on the suction surface. However, since the upper surface of the second engagement top plate portion 115*a* has its three sides thereof being surrounded by the second top plate portion 112 having a large height, the upper surface is hardly damaged by coming into contact with other members during operations such as assembly steps. Therefore, the upper surface of the second engagement top plate portion 115*a* is free of uneven structures and is thus able to reliably function as a suctioned surface.

Moreover, spaces between the second engagement top plate portion 115*a* and the second bottom plate portion 118 on both left and right sides of the second engagement support wall portion 115*b* are configured as second concave engagement portions 113*a* as concave portions which are engaged with the first connector 1. The first terminal restricting portion 16 and the first contacting distal end portion 55 of the first terminal 51 are inserted into the second concave engagement portions 113*a*. Furthermore, slit-like openings which are formed between both left and right edges of the second engagement top plate portion 115*a* and the second side wall portions 117 on the left and right sides so as to extend in the front-to-rear direction are configured as second lateral engagement concave portions 113*b* which are in communication with the second concave engagement portions 113*a*. The first engagement side wall portions 15*b* of the first engagement portion 15 are inserted into the second lateral engagement concave portions 113*b*. In addition, on the inner left and right side faces of the second side wall portions 117, second engagement groove portions 117*c* are formed, which are trenches having a rectangular cross section; opened toward the second concave engagement portions 113*a*, and extending in the front-to-rear direction. The first convex engagement portions 15*c* of the first engagement portion 15 are inserted into the second engagement groove portions 117*c*.

Figure 8:
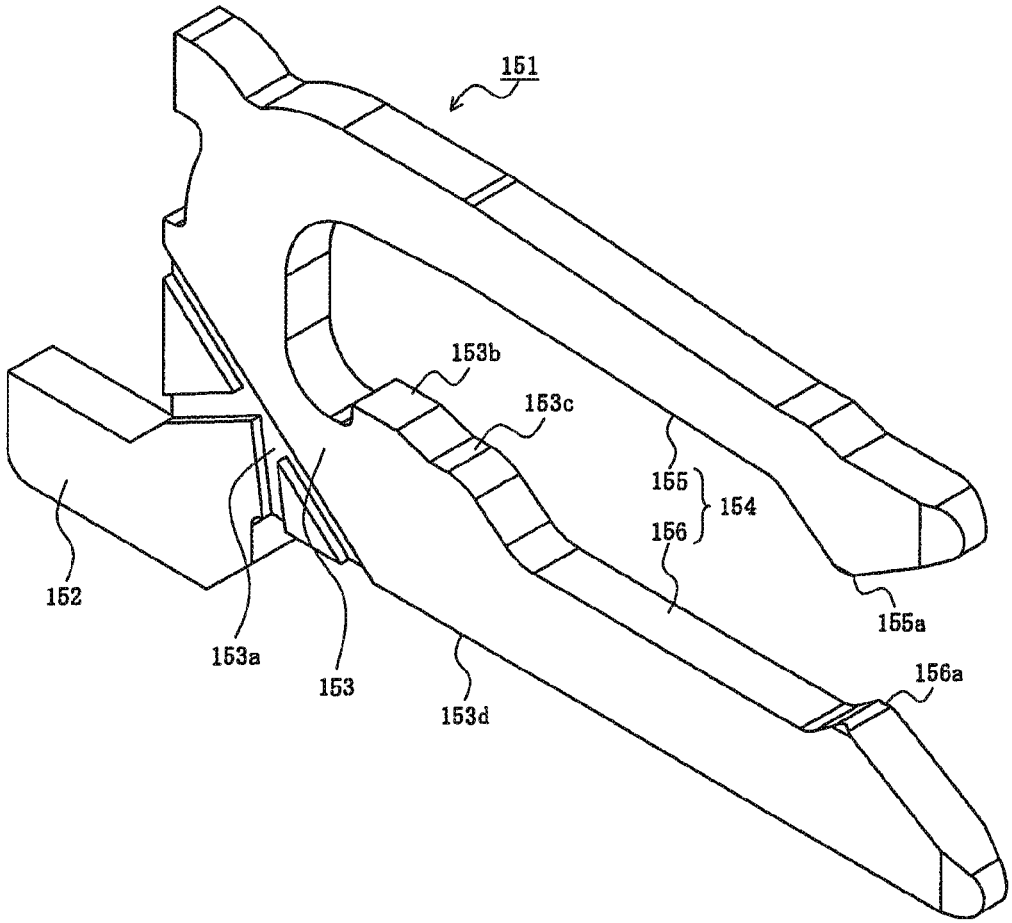
FIG. 8 is a perspective view of the second terminal according to the embodiment of the Present Disclosure.

The second terminals 151 are integrally formed in a bifurcated element by applying processing, e.g., punching, to a metallic plate and have a generally squared C-shaped or U-shaped side form as illustrated in FIG. 8. Each of the second terminals 151 is provided with a second fixing portion 153 as a body portion, a second tail portion 152 as a second surface connecting portion which extends rearward from the lower end of the second fixing portion 153, and a second contacting arm portion 154 which extends frontward from the second fixing portion 153.

In the second tail portion 152, a portion thereof connected to the second fixing portion 153 is accommodated in the second terminal accommodation-concave portion 114*a*, whereas the remaining portion thereof is exposed further rearward (in the leftward direction in FIGS. 6 and 7) than the rear face of the second body portion 114 from the lower end of the second terminal accommodation-concave portion 114*a*. The second tail portion 152 is electrically connected and secured, by soldering or the like, to a second connector electrode portion 193, such as a conductive pad, formed on the top surface of the second board 191. Hence, the second terminals 151 are connected to non-illustrated conductive traces for power supply of the second board 191, formed to be connected to the second connector electrode portions 193. Here, it is preferable that the second tail portion 152 does not protrude rearward from the rearwardly convex portion 117*d* of each of the second side wall portions 117 and does not protrude upward from the upper end of the rearwardly convex portion 117*d*.

The second contacting arm portion 154 is provided with a second upper contacting arm portion 155 which extends frontward from the upper end of the second fixing portion 153 and a second lower contacting arm portion 156 which extends frontward from the lower end of the second fixing portion 153. An upper contacting portion 155*a* configured to protrude downward is formed at the free end, namely in the vicinity of the distal end of the second upper contacting arm portion 155, and a lower contacting portion 156*a* configured to protrude upward is formed at the free end, namely in the vicinity of the distal end of the second lower contacting arm portion 156. The upper contacting portion 155*a* and the lower contacting portion 156*a* are portions which function as second contacting distal end portions of the second terminals 151 and come into electrical contact with the first contacting distal end portions 55 of the first terminals 51. Since at least the second upper contacting arm portion 155 of the second contacting arm portion 154 has some degree of flexibility and is thus able to elastically deform in the vertical direction, at least the upper contacting portion 155*a* is able to elastically deform in the vertical direction to some extents.

A second locking projection 153*b* configured to project upward is formed in a connecting portion of the second fixing portion 153 and the second lower contacting arm portion 156. When the second terminals 151 are press-fitted into the second terminal accommodation-concave portions 114*a*, the second locking projections 153*b* are squeezed into the lower surfaces of the second terminal holding portions 114*b* so that they are locked. Moreover, the upper end portion 153*c* and the lower end portion 153*d* of the second fixing portion 153 are pressed against the lower surface of the second terminal holding portion 114*b* and the upper surface of the second bottom plate portion 118, respectively. That is to say, the second terminals 151 are securely held in the second terminal accommodation-concave portions 114*a* when the second locking projections 153*b* are squeezed into the lower surfaces of the second terminal holding portions 114*b* and the second fixing portions 153 are pinched from the upper and lower sides by the second terminal holding portions 114*b* and the second bottom plate portion 118.

For prevention of flux creep, a plurality of groove portions 153*a* is formed on the side faces of the second fixing portion 153. When the second tail portion 152 is soldered to the second connector electrode portion 193 formed on the top surface of the second board 191, a flux creep phenomenon generally occurs in which flux contained in the solders generally melts down to creep up along the surface of the second terminal 151. Since the flux has insulating properties, when the flux adheres on the surface of the second upper contacting arm portion 155 and the second lower contacting arm portion 156, it is difficult to achieve an electrical connection with the first contacting distal end portions 55 of the first terminals 51. In such a case, the flux creep mainly occurs in the side faces of the second terminals 151. Therefore, the groove portions 153*a* are formed on the side faces of the second fixing portion 153. The number, the width, the depth, the shape and the like of the groove portions 153*a* are appropriately determined in consideration of the strength or the like of the second fixing portion 153.

Figure 7:
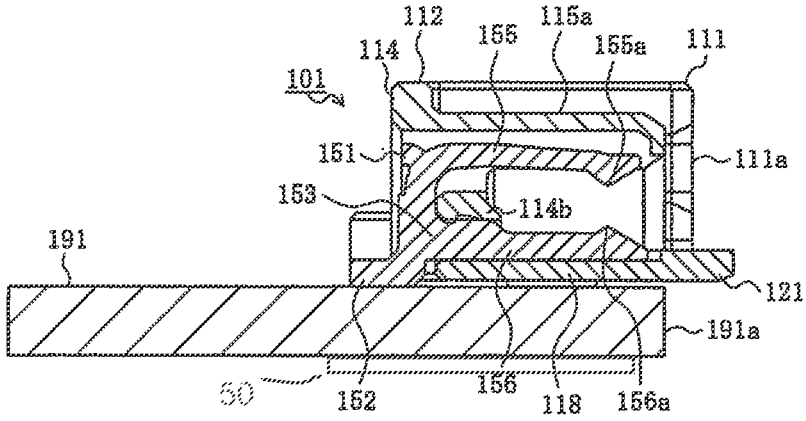
FIG. 7 is a side sectional view of the second connector mounted on the board, taken along the arrows B-B in FIG. 6A.

The second connector 101 is mounted on the end of the second board 191 as illustrated in FIGS. 6 and 7 because it is designed to be engaged, by fitting, with the first connector 1 mounted on the end of the first board 91. Although only the portions disposed in the vicinity of the end of the second board 191 are illustrated in FIGS. 6 and 7 for convenience's sake, actually, the second board 191 is in rectangular shape, for example, and is larger than the illustration, and the second connector 101 is mounted on one end of its both longitudinal ends. Specifically, as illustrated in FIG. 7, the second connector 101 is mounted at such a position that the second fitting face 111*a* protrudes outward from an end face 191*a* of the second board 191 and that the front end of the second bottom plate portion 118 of the second housing 111 becomes substantially identical with the end face 191*a* which is one of both longitudinal ends of the second board 191. It should be noted that the front end of the second bottom plate portion 118 is not necessary perfectly even with the end face 191*a* of the second board 191; however, it is preferable that the distance between the front end of the second bottom plate portion 118 and the end face 191*a* of the second board 191 is short, as illustrated in FIG. 7.

The front end of the second bottom plate portion 118 is connected to a second projecting plate portion 121 as a projecting plate portion which is configured to extend frontward. The second projecting plate portion 121 is formed to extend in the distal end direction from the front end of the second bottom plate portion 118 so as to protrude frontward from the front end of the second engagement portion 115 as illustrated in FIG. 5B.

When a conductive member 50 such as a conductive casing, a conductive plate for electromagnetic shielding, a metallic plate for fixation, radiation, or reinforcement, another printed circuit board, another wiring component, or a fixing bracket is arranged on the rear side of the second board 191, the second projecting plate portion 121 functions as an insulating distance-procuring portion. Since the conductive member 50 functions as the ground at zero electric potential, potential difference may occur between the second terminal 151 and the conductive member 50. If the second projecting plate portion 121 is omitted, the insulating distance between a portion of the conductive member 50 arranged on the rear side of the second board 191, and located closer to the front side than the end face 191*a* and the distal end of the second lower contacting arm portion 156 will be shortened. However, since the second projecting plate portion 121 protrudes frontward from the distal end of the second lower contacting arm portion 156 in the lower portion of the second lower contacting arm portion 156, both the clearance and the creepage distance between the conductive member 50 and the distal end of the second lower contacting arm portion 156 can be sufficiently lengthened, and thus, a sufficient insulating distance can be procured. Moreover, when the first connector 1 and the second connector 101 are engaged together by fitting, since a portion of the first contacting arm portion 54 of each of the first terminals 51 will also have its lower portion covered by the second projecting plate portion 121, the insulating distance between the conductive member 50 and the first contacting arm portion 54 of each of the first terminals 51 can be secured by the second projecting plate portion 121.

The second housing 111 of the second connector 101 does not have any projecting wall portion which is positioned between two of the first terminals 51 exposed rearward from the rear surface of the first body portion 14 so as to be capable of functioning as the insulating distance-procuring portion, as in the case of the rearwardly projecting wall portion 21 of the first connector 1, the projecting wall portion may be formed as required. That is to say, a projecting wall portion may be formed to be integral with the second housing 111 at a position between two of the second tail portions 152 exposed rearward from the rear surface of the second body portion 114 so as to project rearward from the rear surface of the second body portion 114. The projecting wall portion formed in this manner can function as the insulating distance-procuring portion and can procure a sufficient insulating distance between two of the second tail portions 152.

A description of an operation of fitting the first connector 1 and the second connector 101 having the above-described structures to be engaged together will be provided. The first connector 1 is surface-mounted on the first board 91 in a state where the connecting plate portion 52*b* of the first tail portions 52 of the first terminals 51 are connected, by soldering or the like, to the first connector electrode portions 93 formed on the top surface of the first board 91, and that the first connecting portions 83 of the first auxiliary metallic brackets 81 are connected, by soldering or the like, to the first connector fixing portions 94 formed on the top surface of the first board 91.

Similarly, the second connector 101 is surface-mounted on the second board 191 in a state where the second tail portions 152 of the second terminals 151 are connected, by soldering or the like, to the second connector electrode portions 193 formed on the top surface of the second board 191, and that the second connecting portions 183 of the second auxiliary metallic brackets 181 are connected, by soldering or the like, to the second connector fixing portions 194 formed on the top surface of the second board 191.

Figure 9A:
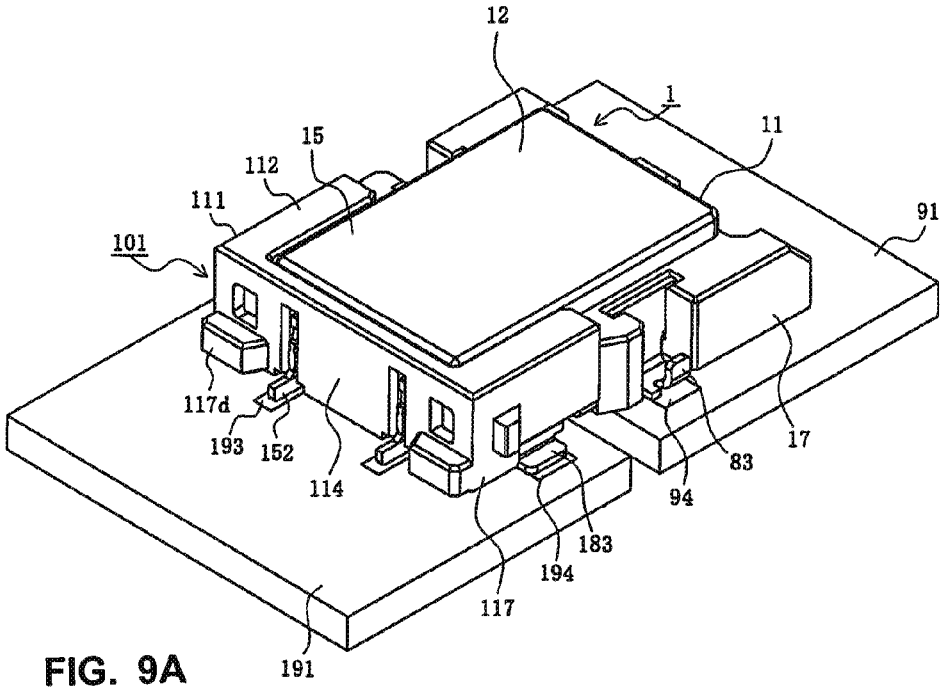
Figure 9B:
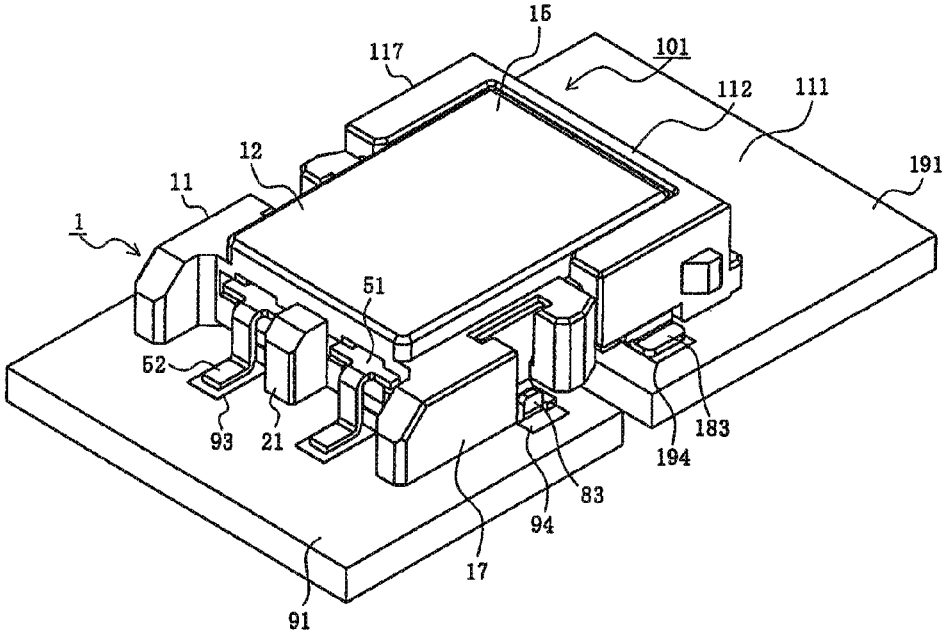
Figure 10:
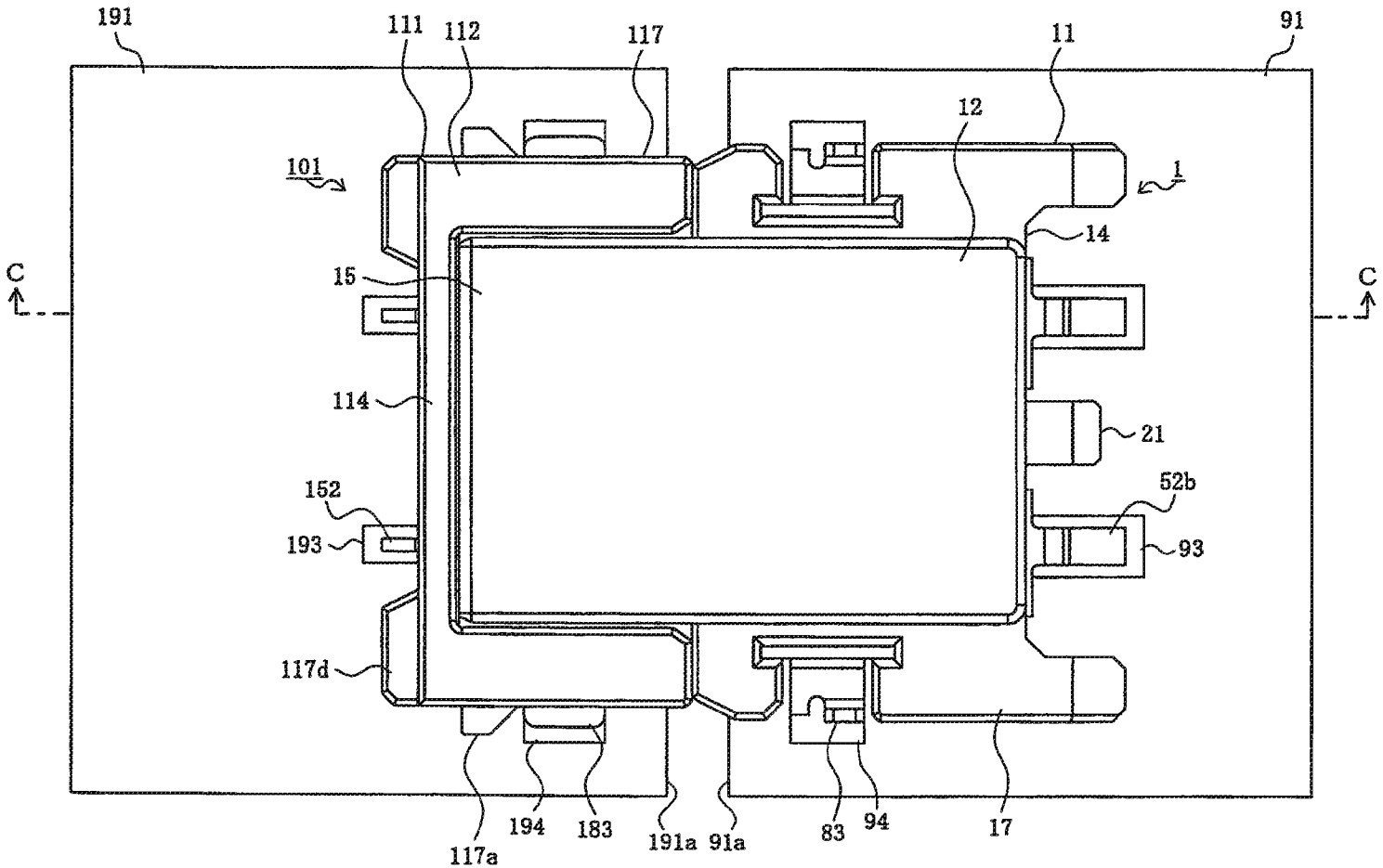
FIG. 10 is a top plan view of the first and second connectors in their tightly engaged state.

Then, an operator moves the first connector 1 and/or the second connector 101 toward either one of the connectors in a state where the first fitting face 11*a* of the first connector 1 opposes the second fitting face 111*a* of the second connector 101 so that the first terminal restricting portions 16 and the first contacting distal end portions 55 of the first terminals 51 of the first connector 1 are inserted into the second concave engagement portions 113*a* of the second connector 101. Moreover, the first engagement side wall portions 15*b* of the first engagement portion 15 of the first connector 1 are inserted into the second lateral engagement concave portions 113*b* of the second connector 101. Furthermore, the first convex engagement portions 15*c* of the first engagement portion 15 of the first connector 1 are inserted into the second engagement groove portions 117*c* of the second connector 101. In this way, the first connector 1 and the second connector 101 are engaged together as illustrated in FIGS. 9 to 11.

Figure 11:
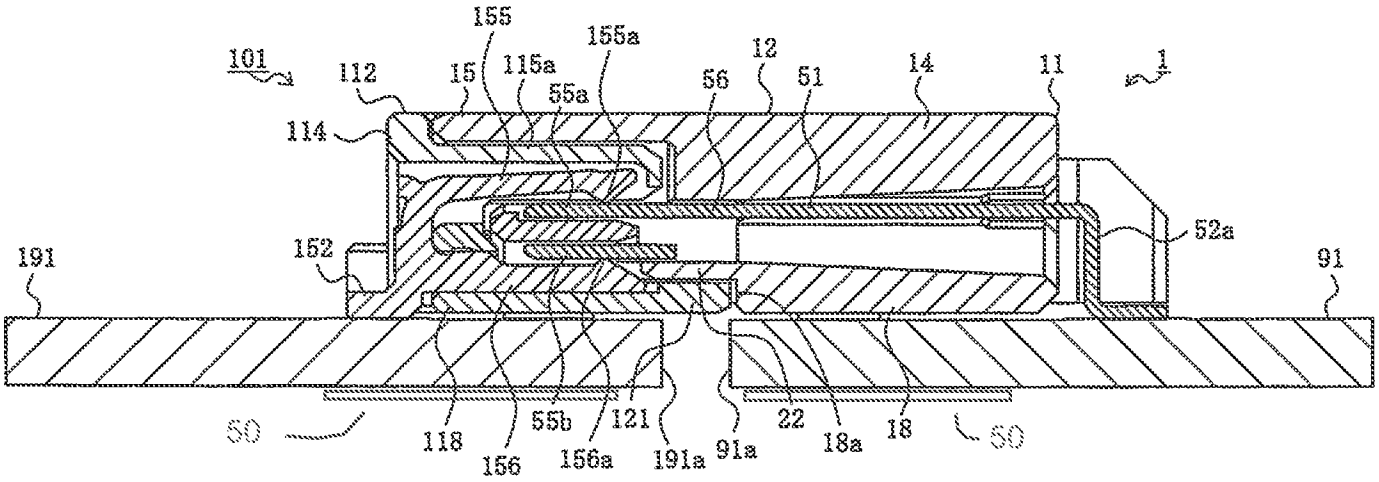
FIG. 11 is a side sectional view of the first and second connectors in their tightly engaged state, taken along the arrows C-C in FIG. 10.
Figure 12:
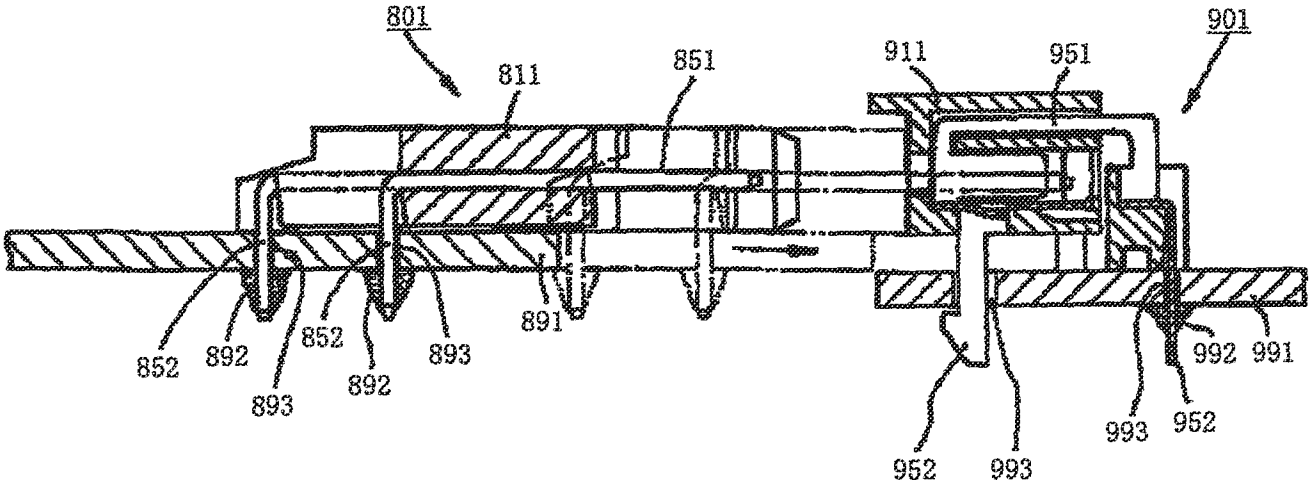
Prior art FIG. 12
FIG. 12 is a side sectional view of a conventional board-to-board connector.

At this time, as illustrated in FIG. 11, the first contacting distal end portions 55 of the first terminals 51 of the first connector 1 come to be positioned between the upper contacting portions 155*a* and the lower contacting portions 156*a* of the second terminals 151 of the second connector 101. Moreover, the upper contacting portions 155*a* and the lower contacting portions 156*a* of the second terminals 151 come into contact with the top plate portion 55*a* and the bottom plate portion 55*b* of the first contacting distal end portions 55. In this way, the first terminals 51 and the second terminals 151 are electrically connected to each other. As a result, the conductive traces connected to the first connector electrode portions 93 on the first board 91 being connected to the first tail portions 52 of the first terminals 51 are electrically connected to the conductive traces connected to the second connector electrode portions 193 on the second board 191 being connected to the second tail portions 152 of the second terminals 151.

When the first contacting distal end portions 55 of the first terminals 51 come to be positioned between the upper contacting portions 155*a* and the lower contacting portions 156*a* of the second terminals 151, the distance between the upper contacting portions 155*a* and the lower contacting portions 156*a* is increased. In this case, the second upper contacting arm portions 155 are elastically deformed vertically, so that the upper contacting portions 155*a* are elastically displaced upwardly, thereby increasing the distance between the upper contacting portions 155*a* and the lower contacting portion 156*a*. Therefore, the operator is able to perceive, by a sense of click-feeling, the resistance that the first contacting distal end portions 55 of the first terminals 51 receive when the upper contacting portions 155*a* are elastically displaced upwardly. Accordingly, the operator is able to correctly become aware of and to confirm completion of the operation of electrically connecting the first terminals 51 and the second terminals 151 so that the first connector 1 and the second connector 101 are engaged together. Moreover, since the first contacting distal end portions 55 of the first terminals 51 are elastically grasped from the upper and lower sides by the upper contacting portions 155*a* and the lower contacting portions 156*a* of the second terminals 151, it is possible to certainly maintain stable contact between the first contacting distal end portions 55 and the upper contacting portions 155*a* and the lower contacting portions 156*a*.

When the engagement between the first connector 1 and the second connector 101 is completed, as illustrated in FIG. 11, the second projecting plate portion 121 of the second housing 111 covers the entire lower surface of the first projecting plate portion 22 of the first housing 11. Therefore, a portion disposed right above a spacing between the end face 91*a* of the first board 91 and the end face 191*a* of the second board 191 is covered by the first projecting plate portion 22 and the second projecting plate portion 121 which overlap with each other.

As described above, when a conductive member 50 such as a conductive casing, a conductive plate for electromagnetic shielding, a metal plate for fixation, radiation, or reinforcement, another printed circuit board, another wiring component, or a fixing bracket is arranged on the rear side of the first board 91 and the second board 191, since the conductive member 50 functions as the ground at zero electric potential, if the first projecting plate portion 22 and the second projecting plate portion 121 do not appear, the insulating distance between the conductive member 50 disposed under the gap between the end face 91*a* of the first board 91 and the end face 191*a* of the second board 191 and the first terminals 51 and/or the second terminals 151 will be shortened. As will be easily understood from FIG. 11, particularly, the insulating distance between the conductive member 50 and the bottom plate portions 55*b* of the first contacting distal end portions 55 of the first terminals 51 and/or the distal ends of the second lower contacting arm portions 156 of the second terminals 151 will also be shortened.

However, the first projecting plate portion 22 and the second projecting plate portion 121 which overlap with each other cover the portion disposed right above the spacing between the end face 91*a* of the first board 91 and the end face 191*a* of the second board 191. Therefore, both the spatial distance and the creepage distance between the conductive member 50 and the bottom plate portions 55*b* of the first contacting distal end portions 55 of the first terminals 51 and/or the distal ends of the second lower contacting arm portions 156 of the second terminals 151 can be sufficiently lengthened, and thus, a sufficient insulating distance can be procured.

For example, as will be obvious from the example illustrated in FIG. 11, the above-mentioned creepage distance can be sufficiently long by virtue of the fact that it is approximately identical to the total sum of the distances of paths: including a path extending from the lower end to the upper end of the first board 91 along its end face 91*a*; a path extending from the lower end to the upper end of the first bottom plate portion 18 along its front end face 18*a* (or a path extending from the lower end to the upper end of the second projecting plate portion 121 along its front end face); and a path extending from the base end to the distal end of the first projecting plate portion 22 along its lower surface (or a path extending from the distal end to the base end of the second projecting plate portion 121 along its upper surface).

Therefore, it is possible to certainly prevent occurrence of any short-circuit accidents between the conductive member 50 and the first terminals 51 and/or the second terminals 151. In the example illustrated in the drawing figures, only the first contacting distal end portion 55 and the first flexible portion 56 of each of the first terminals 51 are configured to protrude outward from the front end of the first bottom plate portion 18 and are positioned right above a place between the front end of the first bottom plate portion 18 and the front end of the second bottom plate portion 118 and right above the spacing between the end face 91*a* of the first board 91 and the end face 191*a* of the second board 191. However, the second upper contacting arm portion 155 or the second lower contacting arm portion 156 of each of the second terminals 151 may be configured to protrude outward from the front end of the second bottom plate portion 118 and are positioned right above a place between the front end of the first bottom plate portion 18 and the front end of the second bottom plate portion 118 and right above the spacing between the end face 91*a* of the first board 91 and the end face 191*a* of the second board 191. Moreover, either one of the first projecting plate portion 22 or the second projecting plate portion 121 may be omitted as required.

When the engagement between the first connector 1 and the second connector 101 is completed, the first engagement side wall portions 15*b* of the first engagement portion 15 of the first housing 11 come into the second lateral engagement concave portions 113*b* of the second housing 111. Moreover, the first convex engagement portions 15*c* of the first engagement portion 15 of the first housing 11 come into the second engagement groove portions 117*c* of the second housing 111, and the first engagement top plate portion 15*a* of the first engagement portion 15 of the first housing 11 comes into the central concave portion 113 of the second housing 111. Furthermore, the first engagement top plate portion 15*a* overlaps the upper surface of the second engagement top plate portion 115*a* of the second housing 111. Owing to the described configuration, the first housing 11 and the second housing 111 can be firmly engaged together, and accordingly, the engagement between the first connector 1 and the second connector 101 is not released even when the relative positional relationship between the first connector 1 and the second connector 101 is changed.

As described above, when a plate member such as a casing, a conductive plate for electromagnetic shielding, a metallic plate for fixation, radiation, or reinforcement, or another printed circuit board is arranged on the rear side of the first board 91 and the second board 191, as illustrated in FIGS. 9 to 11, the first connector 1 and the second connector 101 are first engaged together so that the first board 91 and the second board 191 are connected, and then, the plate member is fixedly secured to the rear side of the first board 91 and the second board 191 by means of fixing members such as screws, bolts or pins. In the state where the first connector 1 and the second connector 101 are engaged together so that the first board 91 and the second board 191 are connected, the respective top surfaces and the respective rear surfaces of the first board 91 and the second board 191 are even with each other, respectively. However, when the plate member is fixedly secured to the rear sides of the first board 91 and the second board 191, due to dimensional errors, attachment errors, and the like of respective portions of the fixing member or the plate member, the respective top surfaces and the respective rear surfaces of the first board 91 and the second board 191 are often unable to be even with each other, respectively. In this case, the relative positional relationship between the first connector 1 and the second connector 101 may be changed.

However, as described above, since the first housing 11 and the second housing 111 are firmly engaged together, the engagement between the first connector 1 and the second connector 101 is not released even when the relative positional relationship between the first connector 1 and the second connector 101 is changed.

Moreover, as described above, each of the first terminals 51 is provided with the first flexible portion 56, and the first contacting distal end portion 55 connected to the distal end of the first flexible portion 56 is configured to be elastically displaceable in the vertical direction. Hence, the first terminals 51 performs the same function as the terminals of a so-called floating connector and is capable of complying with a change in the relative positional relationship between the first connector 1 and the second connector 101. Therefore, even when the relative positional relationship between the first connector 1 and the second connector 101 changes, the contacting state between the first contacting distal end portions 55 of the first terminals 51 and the upper contacting portions 155*a* and the lower contacting portions 156*a* of the second terminals 151 is not released, and a stable electrical connection can be constantly maintained between the first terminals 51 and the second terminals 151.

Nevertheless, if the first contacting distal end portion 55 is displaced greatly in the vertical direction, it may become difficult to insert the first contacting distal end portion 55 between the upper contacting portion 155*a* and the lower contacting portion 156*a* of each of the second terminals 151 when the first connector 1 and the second connector 101 are engaged by fitting together. However, as described above, since the amount of vertical displacement of the first contacting distal end portion 55 is regulated to a predetermined amount by the first terminal restricting portion 16, the first contacting distal end portion 55 can be easily inserted between the upper contacting portion 155*a* and the lower contacting portion 156*a* when the first connector 1 and the second connector 101 are engaged by fitting together.

The first connector 1 and the second connector 101 may be mounted on both ends of a sheet of board, respectively, so that a plurality of sheets of board is connected in series. For example, "n" sheets ("n" is a natural number of 2 or more) of board are prepared, and the first connector 1 is mounted on one end of each board and the second connector 101 is mounted on the other end of each board. Then, the first connector 1 on the first sheet of board is engaged with the second connector 101 on the second sheet of board, the first connector 1 on the second sheet of board is engaged with the second connector 101 on the third sheet of board, and similarly, the first connector 1 on the (n−1)-th sheet of board is engaged with the second connector 101 on the n-th sheet of board. In this way, "n" sheets of board can be connected in series. Subsequently, the second connector 101 on the first sheet of board is engaged with a cable connector connected to the termination end of a non-illustrated power supply cable, and the first connector 1 on the n-th sheet of board is engaged with a non-illustrated loop connector having its left and right terminals being electrically connected. In this way, it is possible to achieve a state where the two power supply lines formed on each board are connected in series.

As described above, the board-to-board connector includes the first connector 1 having the first housing 11 made of an insulating material and the first terminals 51 fitted in the first housing 11, the first connector 1 being configured to be surface-mounted on the top surface of the first board 91 and having the first fitting face 11*a* thereof extending in the direction intersecting the top surface of the first board 91; and the second connector 101 having the second housing 111 made of an insulating material and the second terminals 151 fitted in the second housing 111 and configured to make contact with the first terminals 51, the second connector 101 being configured to be surface-mounted on the top surface of the second board 191 to be engaged with the first connector 1 and having the second fitting face 111*a* thereof extending in the direction intersecting the top surface of the second board 191. The first housing 11 or the second housing 111 is provided with the insulating distance-procuring portion which is configured to protrude outward from the surface thereof and be capable of procuring an insulating distance of the first terminals 51 or the second terminals 151.

Owing to such a configuration, it is possible to absorb the mutual displacement between the first connector 1 and the second connector 101 and to realize a small height and a miniaturization while preventing occurrence of short-circuit accidents. Accordingly, it is possible to provide a board-to-board connector which can be easily produced to have a simple structure with a small number of components and at a low cost.

Moreover, the first housing 11 is provided with the first bottom plate portion 18 configured to oppose the top surface of the first board 91 and is mounted on an end of the first board 91, the second housing 111 is provided with the second bottom plate portion 118 configured to oppose the top surface of the second board 191 and is mounted on an end of the second board 191, and the insulating distance-procuring portion is the projecting plate portion which extends from the front end of the first or second bottom plate portions 18, 118. Owing to such a configuration, the lower portions of the first terminals 51 or the second terminals 151 are covered by projecting plate portion, and accordingly, it is possible to procure a sufficient insulating distance between the first terminals 51 or the second terminals 151.

Furthermore, when the first connector 1 and the second connector 101 are engaged together, a portion of each of the first terminals 51 or the second terminals 151 is positioned right above a portion which is disposed between the front end of the first bottom plate portion 18 and the front end of the second bottom plate portion 118, and the projecting plate portion covers the lower portion of the portion of each of the first terminals 51 or the second terminals 151, disposed right above the portion between the front end of the first bottom plate portion 18 and the front end of the second bottom plate portion 118. Owing to such a configuration, even when a conductive member 50 is present between the front end of the first bottom plate portion 18 and the front end of the second bottom plate portion 118, it is possible to secure a sufficient insulating distance between the conductive member 50 and the first terminals 51 or the second terminals 151.

Furthermore, the projecting plate portion includes the first projecting plate portion 22 extending from the front end of the first bottom plate portion 18 and the second projecting plate portion 121 extending from the front end of the second bottom plate portion 118. The first and second projecting plate portions 22, 121 overlap with each other when the first connector 1 and the second connector 101 are engaged together. Owing to such a configuration, even when a conductive member 50 is present between the front end of the first bottom plate portion 18 and the front end of the second bottom plate portion 118, it is possible to secure a sufficient creepage distance between the conductive member 50 and the first terminals 51 or the second terminals 151.

Furthermore, a plurality of the first terminals 51 is provided, each of the first terminals 51 being provided with the first tail portion 52 which is exposed from the top surface of the first housing 11 to be connected to the top surface of the first board 91, a plurality of the second terminals 151 is provided, each of the second terminals 151 being provided with the second tail portion 152 which is exposed from the top surface of the second housing 111 to be connected to the top surface of the second board 191, and the insulating distance-procuring portion includes the projecting wall portion which is disposed between the neighboring ones of the first tail portions 52 or the second tail portions 152 and is configured to project outward from the top surface of the first housing 11 or the second housing 111. Owing to such a configuration, it is possible to secure a sufficient insulating distance between the neighboring ones of the first tail portions 52 or between the neighboring ones of the second tail portions 152.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector comprising:

a first connector, the first connector including a first housing made of an insulating material and a first terminal fitted in the first housing, the first connector being mounted on a top surface of a first board and including a fitting face extending in a direction intersecting the top surface of the first board, the first housing further including a first bottom plate portion opposing the top surface of the first board and mounted on a surface of an end of the first board; and a second connector, the second connector including a second housing made of an insulating material and a second terminal fitted in the second housing and contacting the first terminal, the second connector being mounted on a top surface of a second board engaged with the first connector and including a fitting face extending in a direction intersecting the top surface of the second board, the second housing further including a second bottom plate portion opposing the top surface of the second board and mounted on a surface of an end of the second board;

wherein the first housing and the second housing each include an insulating distance-procuring portion, each insulating distance-procuring portion protruding outward from a surface thereof and defining an insulating distance between the first terminal and the second terminal, each insulating distance-procuring portion including a projecting plate portion which extends from a front end of the first bottom plate portion and a front end of the second bottom plate portion, respectively.

2. The board-to-board connector according to claim 1, wherein when the first connector and the second connector are engaged together, a portion of the first terminal or the second terminal is positioned right above a place between a front end of the first bottom plate portion and a front end of the second bottom plate portion, and one of the projecting plate portions covers an under part of a portion of the first terminal or the second terminal, positioned right above the portion disposed between the front end of the first bottom plate portion and the front end of the second bottom plate portion.

3. The board-to-board connector according to claim 2, wherein:

the projecting plate portions comprise a first projecting plate portion extending from the front end of the first bottom plate portion and a second projecting plate portion extending from the front end of the second bottom plate portion; and the first projecting plate portion and the second projecting plate portion overlap each other when the first connector and the second connector are engaged together.

4. The board-to-board connector according to claim 3, wherein a conductive member is arranged on a rear surface of the first board or the second board.

5. The board-to-board connector according to claim 4, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

6. The board-to-board connector according to claim 1, wherein a conductive member is arranged on a rear surface of the first board or the second board.

7. The board-to-board connector according to claim 6, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

8. The board-to-board connector according to claim 2, wherein a conductive member is arranged on a rear surface of the first board or the second board.

9. The board-to-board connector according to claim 8, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

10. The board-to-board connector according to claim 1, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

11. The board-to-board connector according to claim 2, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

12. The board-to-board connector according to claim 3, wherein:

the first terminal comprises a plurality of first terminals, each first terminal including a first surface connecting portion exposed from the surface of the first housing and connected to the top surface of the first board;

the second terminal comprises a plurality of second terminals, each second terminal including a second surface connecting portion exposed from the surface of the second housing and connected to the top surface of the second board; and each insulating distance-procuring portion includes a projecting wall portion arranged to project outward from the top surface of the first housing or the second housing between neighboring ones of the first surface connecting portions or those of the second surface connecting portions, respectively.

13. The board-to-board connector of claim 4, wherein the insulating distance-procuring portion prevents a short circuit between the first and second terminals and the conductive member.

14. The board-to-board connector of claim 6, wherein the insulating distance-procuring portion prevents a short circuit between the first and second terminals and the conductive member.

15. The board-to-board connector of claim 1, wherein the insulating distance-procuring portion prevents a short circuit between the first and second terminals and the conductive member.

16. The board-to-board connector of claim 8, wherein the insulating distance-procuring portion prevents a short circuit between the first and second terminals and the conductive member.

* * * * *